United States Patent [19]

Hanzlik

[11] Patent Number: 4,703,927

[45] Date of Patent: Nov. 3, 1987

[54] JOGGER'S HAND WEIGHT & WATER BOTTLE FOR DRINKING

[76] Inventor: Andrew Hanzlik, Box 123, Riegelsville, Pa. 18077

[21] Appl. No.: 878,675

[22] Filed: Jun. 26, 1986

[51] Int. Cl.[4] ..... A63B 11/00

[52] U.S. Cl. ..... 272/122; 272/DIG. 9; 215/6

[58] Field of Search ..... 272/67, 68, 93, 119, 272/122, 130, 143, DIG. 9; 206/217, 542, 549, 315.1; 215/1 A, 6; D9/374, 381; 224/148

[56] References Cited

U.S. PATENT DOCUMENTS

| | | | |
|---|---|---|---|
| D. 224,701 | 9/1972 | Wright | D9/381 X |
| D. 226,168 | 1/1973 | Muscatiello | D9/381 X |
| D. 270,237 | 8/1983 | Hestehave | D9/374 X |
| 3,349,987 | 10/1967 | Weitzner | 215/1 A X |
| 3,814,288 | 6/1974 | Westrich | 215/6 X |
| 4,222,560 | 9/1980 | Hallerman | 272/130 X |
| 4,228,908 | 10/1980 | Tweeton | 224/148 X |
| 4,339,062 | 7/1982 | Witt, Jr. | 224/148 |
| 4,548,339 | 10/1985 | Gorman | 215/6 X |
| 4,575,074 | 3/1986 | Damratoski | 272/122 X |
| 4,603,784 | 8/1986 | Chang | 215/6 X |

*Primary Examiner*—Richard J. Apley
*Assistant Examiner*—Robert W. Bahr
*Attorney, Agent, or Firm*—Gregory J. Gore

[57] ABSTRACT

A jogger's hand weight for exercising the muscles of the upper body incorporates two (2) internal chambers; one chamber for holding a quantity of weighting materials so that the weight of the device may be varied, and a second chamber for holding a quantity of drinking fluid. A straw tube is included in the drinking fluid compartment so that the fluid may be consumed by the runner without interrupting his motion. The hand weight has a U-shaped design so that both compartments fall on opposite sides of the hand when grasped as intended.

3 Claims, 3 Drawing Figures

FIG. 1
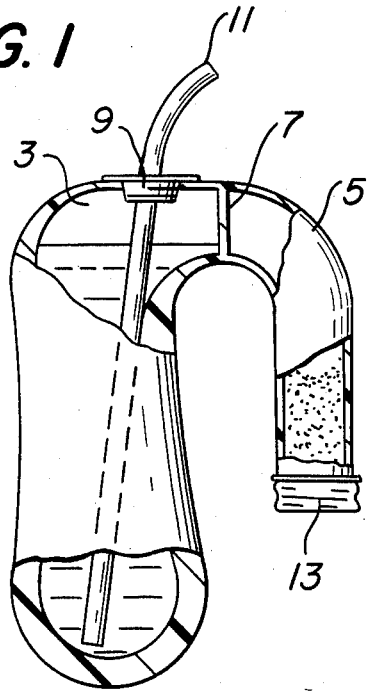
FIG. 2
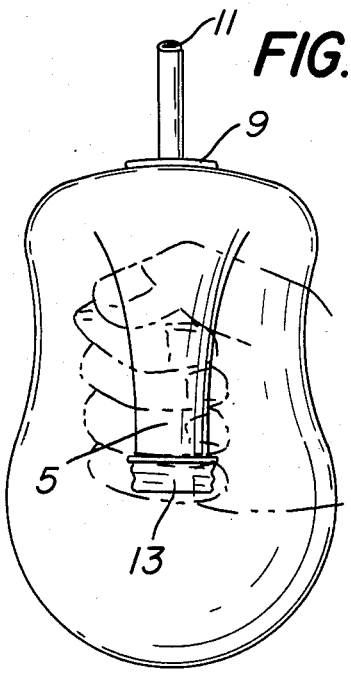
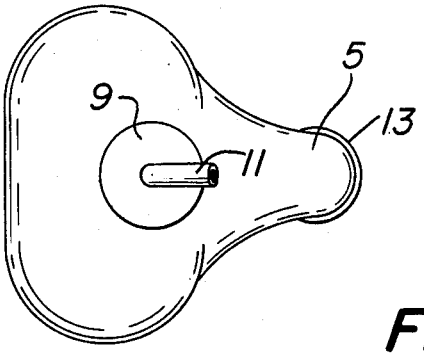
FIG. 3

JOGGER'S HAND WEIGHT & WATER BOTTLE FOR DRINKING

FIELD OF THE INVENTION

This invention relates to the field of athletic conditioning and is intended to facilitate exercise for running or jogging.

BACKGROUND OF THE INVENTION

The recent increase of popularity in physical exercise, particularly through running or jogging, has spawn many types of related exercise equipment. Among this athletic equipment for runners has been hand weights which may be worn as weighted gloves in order to help strengthen the muscles of the upper body during running, which is an exercise mainly involving the muscles of the lower body only. Other than the glove-type hand weights, there are the usual dumbbell-type hand weights which have a central bar member for grasping.

It is also known that running as an exercise, especially over great distances, requires the replenishment of body fluids which are quickly lost during this type of exercise. To meet this need, containers for holding water and the like are known to be belt-mounted and can be removed from a holder for drinking while running.

The instant invention combines the hand weight and drinking container apparatuses into a single unit. This provides many advantages and improvements over the prior art as will be discussed below.

SUMMARY OF THE INVENTION

The present invention includes a specifically designed hand-held weighted container for holding drinking fluid and other weight materials. The use of the container is further facilitated by an elongated drinking straw attached thereto so that fluids in the container can be consumed while running. A desirable ancillary effect is the fact that for exercise training this means that hand weights decrease their weight over the course of the exercise period. This is a natural adaptation to reduce the pressure on the muscles as they become more tired. Furthermore, because the container is held in the hand, it is convenient for holding close to the mouth of the runner without the necessity of removing any other holders from waistbelts or other supporting garments.

There is also provision in the hand weight for the inclusion of additional weighting materials so that a preferred weight may be achieved. Furthermore, the unique "U-shaped" design of the hand weight includes a configuration which produces a comfortable balance in the hands of the runner which are normally held in a substantially upright, clenched fist in front of the runner's body.

More specifically, the invention includes a broad, flat front portion for drinking fluid containment, a dividing membrane creating two (2) compartments, and a second weight-containing compartment on the other side of the membrane. Both compartments are designed to be located on both the front and back of the hand with the hand held in a "thumbs up" vertical position. In addition, a screw top and drinking straw elements are included so that the fluids can easily be consumed while running and replenished as needed. The weight containment chamber likewise has a threaded aperture with a screw-fitting closure to retain weight materials inserted therein, such as lead shot, sand or other suitable materials.

BRIEF DESCRIPTION OF THE DRAWINGS

FIG. 1 is a side view of the exercise device of the present invention, partially sectioned to show the two internal chambers.

FIG. 2 is a rear view of the invention showing how it is held by the jogger.

FIG. 3 is a top view.

DESCRIPTION OF THE PREFERRED EMBODIMENT

Referring now to FIG. 1, this exercise device is relatively uncomplicated and is a one-piece unit preferably made of plastic. The body includes dual chambers 3 and 5, separated by membrane 7. Chamber 3 is for holding drinking fluids such as water, and chamber 5 contains other weight materials such as lead shot, sand, and the like. The shape and dimension of chamber 5 is made so that it is suitable as a handle for grasping by the runner. Screw top 9 is fitted to the top of the drinking fluid chamber 3 and functions as access means to fill the chamber. Straw means 11 enables the runner to drink fluid without interrupting his motion. Screw closure 13 provides access means at the bottom of chamber 5 for removing or adding weight materials.

FIG. 2 shows how the U-shaped exercise and drinking device fits in the hand of the user. As can be seen from this figure, when the hand is in the natural "thumbs up" running position, both chambers 3 and 5 fall on either side of the hand providing a natural balance point for the weights across the top of the hands.

The invention may be embodied in other specific forms without departing from the spirit or essential characteristics thereof. The present embodiment is therefore to be considered in all respects as illustrative and not restrictive. The scope of the invention to be determined by the appended claim and its legal equivalents.

What is claimed is:

1. A beverage container and hand-weight, comprising:

(a) a one-piece body having two chambers therein, (b) a first chamber containing a drinking fluid, (c) a second chamber containing exercise weights, such as lead shot or sand, (d) a dividing membrane proximate the top of said first and second chambers to prevent crosscontamination between said first and second chambers, (e) first access means at the top of said first chamber for introducing and removing drinking fluids therefrom, said first chamber otherwise being continuous in cross section, (f) second access means on the bottom of said second chamber for introducing or removing exercise weights therefrom, said second access means lying proximate the bottom of said first chamber, and (g) tube means extending from said access means on said first chamber to act as a drinking straw so that a jogger may consume the fluids therefrom without stopping his motion.

2. The beverage container and hand weight of claim 1 wherein said second chamber is a handle.

3. The beverage container and hand weight of claim 2 further described in that said first and second chambers are elongated cavities which are substantially parallel to each other.

* * * * *